US007581936B2

(12) United States Patent
Ogasawara et al.

(10) Patent No.: US 7,581,936 B2
(45) Date of Patent: Sep. 1, 2009

(54) HERMETICALLY SEALED COMPRESSOR HAVING OIL SUPPLY MECHANISM BASED ON REFRIGERANT PRESSURE

(75) Inventors: Hirotsugu Ogasawara, Ota (JP); Takahiro Nishikawa, Ora-Gun (JP); Masayuki Hara, Ota (JP); Hiroyuki Yoshida, Ota (JP); Yoshihisa Kogure, Ora-Gun (JP); Akira Hashimoto, Ota (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 11/378,800

(22) Filed: Mar. 16, 2006

(65) Prior Publication Data

US 2006/0210408 A1 Sep. 21, 2006

(30) Foreign Application Priority Data

Mar. 17, 2005 (JP) ..... 2005-076664
Mar. 31, 2005 (JP) ..... 2005-101232
Mar. 31, 2005 (JP) ..... 2005-101233

(51) Int. Cl.
*F03C 2/00* (2006.01)
*F03C 4/00* (2006.01)
*F04C 2/00* (2006.01)

(52) U.S. Cl. ..... 418/63; 418/88; 418/94; 418/99; 418/270

(58) Field of Classification Search ..... 418/63, 418/55.1, 55.6, 88, 94, 99, 270, 60; 184/6.18
See application file for complete search history.

(56) References Cited

U.S. PATENT DOCUMENTS 3,111,820 A * 11/1963 Atchison ..... 418/99
4,968,223 A * 11/1990 Da Costa ..... 418/88
5,545,021 A * 8/1996 Fukuoka et al. ..... 418/63
5,678,657 A * 10/1997 Lee ..... 418/88

FOREIGN PATENT DOCUMENTS

EP 0903499 3/1999
JP 57173589 A * 10/1982
JP 58101291 6/1983
JP 6-323276 A 11/1994
JP 07293470 11/1995
JP 08114189 5/1996

* cited by examiner

*Primary Examiner*—Theresa Trieu
(74) *Attorney, Agent, or Firm*—Darby & Darby P.C.

(57) ABSTRACT

A hermetically sealed rotary compressor 100 including an electrically-driven element 2, a rotary compressing element 4 equipped with a cylinder 41 having a compression chamber 43 and a hermetically sealed container 1 in which oil 8 is stocked, is equipped with an oil path 62 for injecting the oil 8 into the compression chamber 43 when refrigerant is sucked into the compression chamber 43, and an opening/closing valve 80 for opening/closing the oil path 62 in accordance with the discharge pressure of the rotary compressing element 4 of the pressure of the compressed refrigerant compressed by the rotary compressing element 4.

6 Claims, 14 Drawing Sheets

HERMETICALLY SEALED COMPRESSOR HAVING OIL SUPPLY MECHANISM BASED ON REFRIGERANT PRESSURE

BACKGROUND OF THE INVENTION

1. Field of the Invention

The present invention relates to a hermetically sealed compressor used for refrigeration and air-conditioning, and particularly to a technique of enhancing COP (Coefficient Of Performance: refrigeration power/input power) of a hermetically sealed compressor.

2. Description of the Related Art

There is known a hermetically sealed rotary compressor including an electrically-driven element and a rotary compression element driven by the electrically-driven element to compress refrigerant that are accommodated in a hermetically sealed container. This type of hermetically sealed rotary compressor is disclosed in JP-A-6-323276, for example. According to this hermetically sealed rotary compressor, an eccentrically rotating roller is disposed in a cylinder so as to keep predetermined clearance from the inner surface of the cylinder and form a crescent-shaped space (so-called compression chamber) in the cylinder. Furthermore, a vane is provided so as to come into sliding contact with the roller, and the crescent-shaped space is partitioned to a refrigerant-sucking low-pressure chamber side and a refrigerant-compressing high pressure chamber side by the vane in terms of pressure.

However, the conventional hermetically sealed rotary compressor has a problem that the sealing performance of the crescent-shaped space is not sufficient, resulting in reduction of the cooling efficiency of the hermetically sealed rotary compressor.

SUMMARY OF THE INVENTION

The present invention has been implemented in view of the foregoing situation, and has an object to provide a hermetically sealed compressor in which the sealing performance between a roller and a cylinder is enhanced and thus the cooling efficiency can be enhanced.

According to an aspect of the present invention, there is provided a hermetically sealed compressor comprising: an electrically-driven element; a rotary compressing element driven by the electrically-driven element to compress refrigerant; the rotary compressing element having at least one cylinder including a compression chamber in which the refrigerant is compressed; a hermetically sealed container in which the electrically-driven element and the rotary compressing element are accommodated and oil is stocked; an oil path for injecting the oil into the compression chamber when the refrigerant is sucked into the compression chamber of the cylinder constituting the rotary compressing element; and an opening/closing valve for opening/closing the oil path in accordance with the refrigerant discharge pressure of the rotary compressing element or the pressure of the compressed refrigerant compressed by the rotary compressing element.

In the hermetically sealed compressor, the opening/closing valve is opened/closed in accordance with the differential pressure between the refrigerant suction pressure and the reference discharge pressure of the compression chamber, and set to an open state when the differential pressure is low.

In the hermetically sealed compressor according to claim 1, the opening/closing valve is opened/closed in accordance with the pressure of the compressed refrigerant, and is set to an open state when the pressure of the compressed refrigerant is low.

The hermetically sealed compressor further comprises a compressed refrigerant introducing path for applying the pressure of the compressed refrigerant discharged from the discharge pipe of the hermetically sealed container to the opening/closing valve.

According to another aspect of the present invention, there is provided a hermetically sealed compressor including an electrically-drive element, a rotary compressing element that is driven by the electrically-driven element and has at least one cylinder including a compression chamber in which the refrigerant is compressed, and a hermetically sealed container in which the electrically-driven element and the rotary compressing element are accommodated, further comprising: an oil supply pipe for supplying oil; an oil path that is connected to the oil supply pipe and injects the oil into the compression chamber when the refrigerant is sucked into the compression chamber; and an electromagnetic valve that is provided to the oil supply pipe and opened/closed in accordance with a driving frequency of the rotary compressing element.

In the hermetically sealed compressor, the electromagnetic valve is set to an open state when the rotary compressing element is set to a low load power area.

In the hermetically sealed compressor, the oil is stocked in the hermetically sealed container and the oil is supplied to the oil path through the oil supply pipe.

The hermetically sealed compressor further comprises a refrigerant circuit having an oil separator, wherein the oil supply pipe is connected to the oil separator, and the oil separated from the refrigerant by the oil separator is led through the oil supply pipe to the oil path.

The hermetically sealed compressor further comprises a pressure reducing unit that is provided between the oil separator and the electromagnetic valve and reducing the pressure of the oil supplied from the oil separator.

DETAILED DESCRIPTION OF THE PREFERRED EMBODIMENTS

Preferred embodiments according to the present invention will be described hereunder with reference to the accompanying drawings.

First Embodiment

Figure 1:
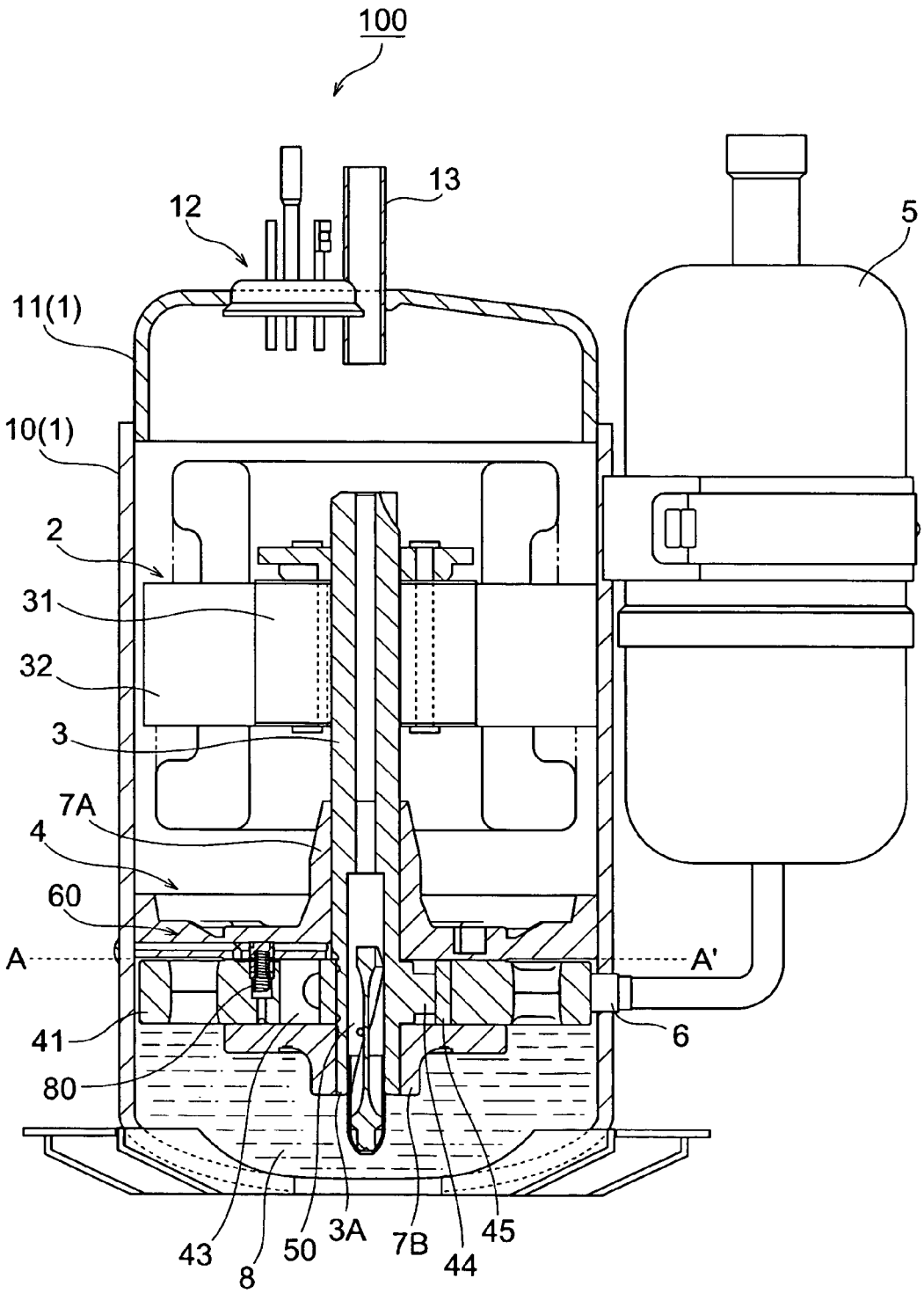
FIG. 1 is a longitudinally-sectional view showing the construction of a hermetically sealed rotary compressor according to a first embodiment of the present invention.
Figure 2:
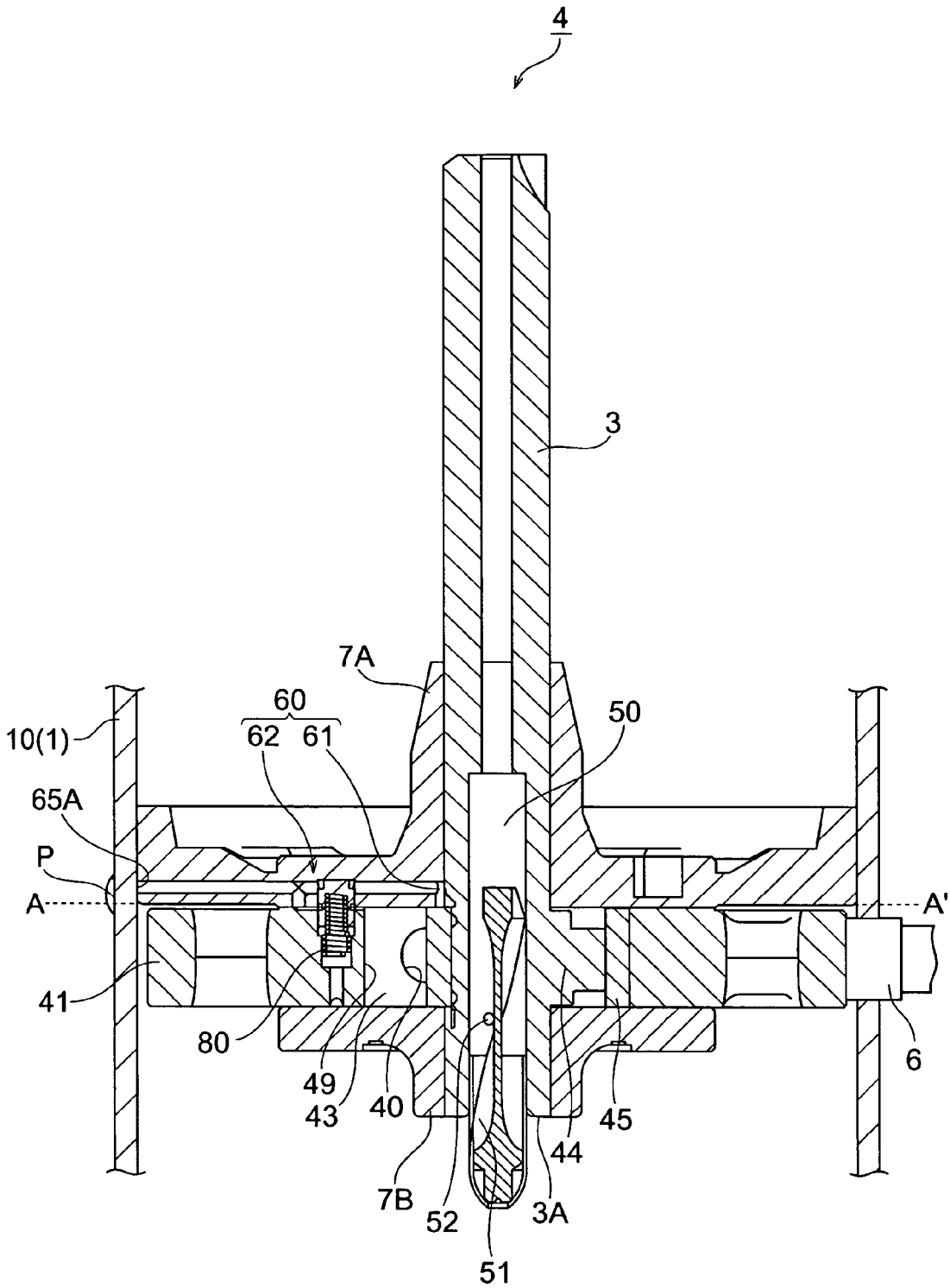
FIG. 2 is an enlarged longitudinally-sectional view showing a rotary compressing element.

FIG. 1 is a longitudinally-sectional view showing a hermetically sealed rotary compressor according to a first embodiment of the present invention, and FIG. 2 is an enlarged longitudinally-sectional view of a rotary compressing element. The hermetically sealed rotary compressor 100 constructs a refrigerating unit by connecting a condenser for refrigerant and an evaporator for refrigerant through a pipe. As shown in FIG. 1, the hermetically sealed rotary compressor 100 has a hermetically sealed container 1, an electrically-driven element 2 accommodated at the upper side of the hermetically sealed container 1, and a rotary compressing element 4 accommodated at the lower side of the hermetically sealed container 1. The rotary compressing element 4 is driven by a crank shaft 3 of the electrically-driven element 2 to compress refrigerant.

The hermetically sealed container 1 is equipped with a cylindrical shell portion 10, and an end cap 11 fixed to the shell portion 10 by arc welding or the like, and the end cap 11 is provided with a terminal 12 serving as a relay terminal when power is supplied to the electrically-driven element 2, and a discharge pipe 13 for discharging compressed refrigerant to the outside of the compressor 100. Furthermore, a suction pipe 6 for leading refrigerant from an accumulator 5 to the rotary compressing element 4 is fixed to the neighborhood of the bottom portion of the shell portion 10 by welding, for example.

The electrically-driven element 2 comprises a DC motor such as a so-called DC brushless motor or the like, and it is equipped with a rotor 31 and a stator 32 fixed to the shell portion 10. The crank shaft 3 is fixed to the rotor 31, and the crank shaft 3 is freely rotatably mounted to a primary bearing 7A and an secondary bearing 7B equipped to the rotary compressing element 4 so that the rotating force of the rotor 31 is transmitted to the rotary compressing element 4.

The rotary compressing element 4 has one cylindrical cylinder 41, and it is pinched between the primary bearing 7A (support member) and the secondary bearing 7B and integrally fixed to the primary bearing 7A and the secondary bearing 7B by bolts or the like.

The primary bearing 7A is fixed to the inner surface of the hermetically sealed container 1, and the cylinder 41 is supported in the hermetically sealed container 1 by the primary bearing 7A. The opening at the upper side of the cylinder 41 is closed by the primary bearing 7A, and also the opening at the lower side of the cylinder 41 is closed by the secondary bearing 7B, thereby forming a compression chamber 43 in the cylinder 41.

Figure 3:
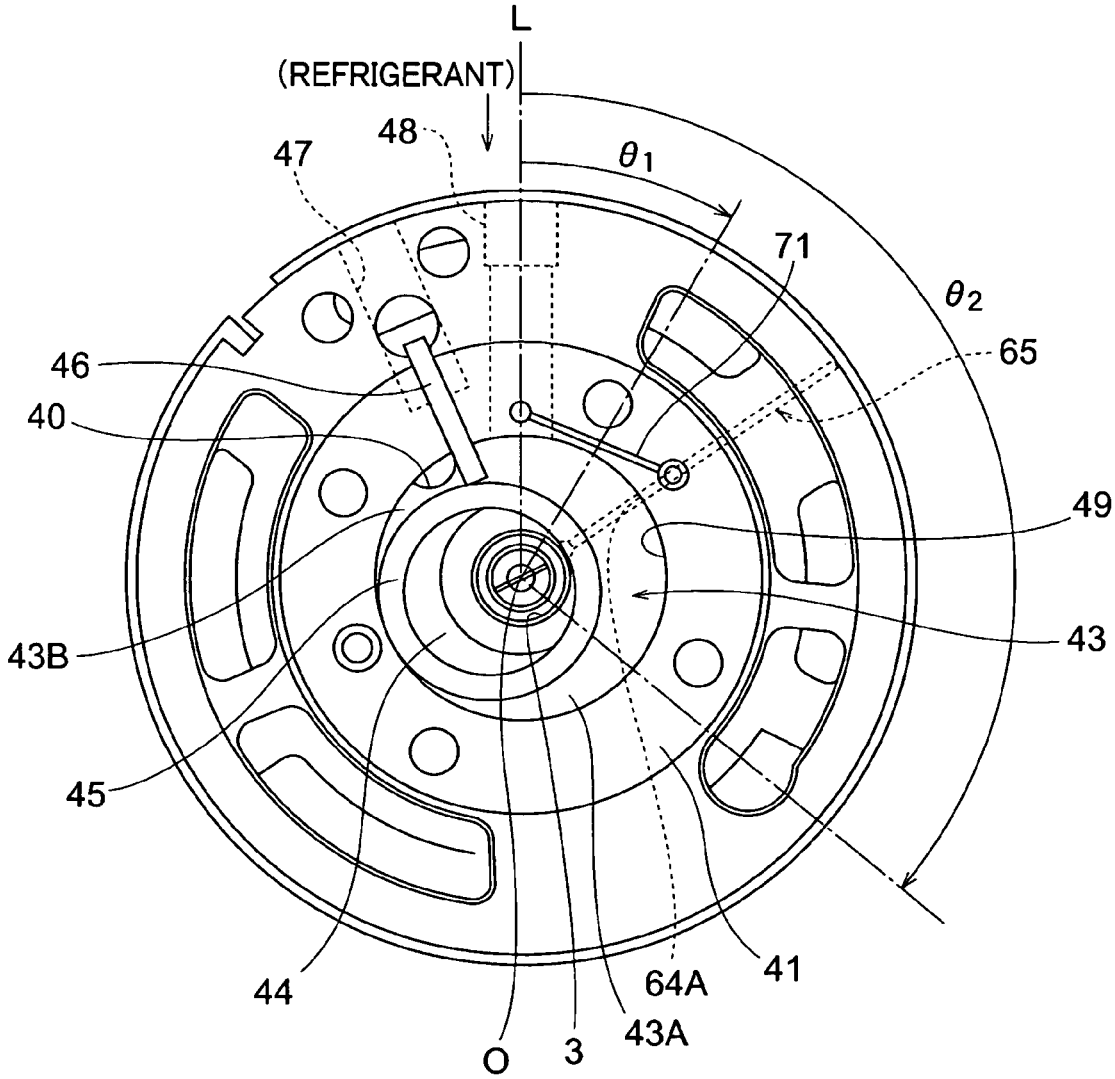
FIG. 3 is a plan view showing a cylinder.

A roller 45 which is fitted in an eccentric portion integrally formed with the crank shaft 3 and eccentrically rotated is provided in the compression chamber 43. Furthermore, as shown in FIG. 3, a refrigerant suction port 48 and a refrigerant discharge port 40 are formed in the cylinder 41. A vane groove 47 extending in the radial direction of the cylinder 41 is provided between the suction port 48 and the discharge port 40, and a vane 46 is freely slidably provided in the vane groove 47. The vane 46 is pressed against the roller 45 by an urging member such as a spring or the like at all times. When the roller 45 is eccentrically rotated, the vane 46 reciprocates in the vane groove 47 in sliding contact with the outer peripheral surface of the roller 45, and it serves to partition the inside of the compression chamber 43 into a low-pressure chamber side 43A and a high-pressure chamber side 43B in terms of pressure.

More specifically, the cylindrical space in the cylinder 41, that is, the compression chamber 43 for refrigerant is constructed in a crescent-shape because the roller 45 is eccentrically disposed in the cylinder 41. The contact of the vane 46 with the peripheral surface of the roller 45A partitions the crescent-shaped compression chamber 43 into the low-pressure chamber side 43A at the refrigerant suction port 48 side and the high-pressure chamber side 43B at the refrigerant discharge port 40 side.

As shown in FIG. 1, the suction pipe 6 is engagedly inserted in the suction port 48 of the cylinder 41, and the discharge port 40 shown in FIG. 3 is provided with a discharge valve. When the refrigerant pressure of the high-pressure chamber side 43B reaches a discharge pressure regulated by the discharge valve, the refrigerant is discharged from the discharge port 40 into the hermetically sealed container 1.

That is, in the hermetically sealed rotary compressor 100, the electrically-driven element 2 rotates the crank shaft 3, so that the roller 45 is eccentrically rotated in the compression chamber 43. Accordingly, the refrigerant supplied from the outside of the compressor through the accumulator 5 is sucked through the suction pipe 6 into the lower pressure chamber side 43A of the compression chamber 43. The refrigerant thus sucked is compressed while fed to the high-pressure chamber side 43B, discharged from the discharge port 40 into the hermetically sealed container 1 and then discharged from the discharge pipe 13 to the outside of the compressor.

As shown in FIG. 1, oil 8 is stocked at the bottom portion of the hermetically sealed container 1 until the lower surface of the primary bearing 7A (indicated by a line A-A' in FIGS. 1 and 2. The lower end portion 3A of the crank shaft 3 is provided with an oil pickup 50 serving as an oil supply device for supplying the oil 8 to the primary bearing 7A, the secondary bearing 7B, the rubbing portion between the rotary compressing element 4 and the crank shaft 3 and the sliding portion of the rotary compressing element 4.

Specifically describing, the crank shaft 3 is designed in a cylindrical shape, and a cylindrical oil pickup 50 is pressed in the lower end portion 3A of the crank shaft 3. As shown in FIG. 2, a paddle 51 constituting a spiral oil flow path is integrally formed in the oil pickup 50. When the crank shaft 3 is rotated, the oil 8 stocked in the hermetically sealed container 1 is sucked up from the lower end 50A of the oil pickup 50 by centrifugal force in connection with the rotation of the paddle 51, passed through an oil supply hole 52 formed at the upper end side of the oil pickup 50 and then supplied as lubricating oil to the primary bearing 7A, the secondary bearing 7B and each rubbing portion between the rotary compressing element 4 and the crank shaft 3.

In order to prevent the abrasion between the roller 45 and the cylinder 41 when the roller 45 is eccentrically rotated, the roller 45 is designed so that predetermined clearance is kept between the roller 45 and the inner surface 49 of the cylinder 41 at the contact place therebetween. However, this clearance degrades the sealing performance of the compression chamber 43, particularly the sealing performance between the low-pressure chamber side 43A and the high-pressure chamber side 43B, and the cooling efficiency would be reduced unless any countermeasure is taken.

Therefore, the hermetically sealed rotary compressor 100 of this embodiment is equipped with an oil injecting portion 60 for injecting the oil 8 stocked in the hermetically sealed container 1 into the compression chamber 43 when the refrigerant is sucked into the compression chamber 43. By injecting the oil 8 into the compressing chamber 43, oil film is formed between the roller 45 and the cylinder 41 to thereby enhance the sealing performance.

As shown in FIG. 2, the oil injecting portion 60 comprises an oil stocking portion 61 for stocking the oil 8 and an oil path 62 for leading the oil 8 stocked in the oil stocking portion 61 to the compression chamber 43 of each of the cylinder 41.

The oil stocking portion 61 is formed by providing an annular space along the outer peripheral surface of the crank shaft 3 at the rubbing face of the primary bearing 7A against the crank shaft 3. Accordingly, when the oil pickup 50 supplies the oil 8 to each rubbing portion between the rotary compressing element 4 and the crank shaft 3, a part of the oil 8 is stocked in the oil stocking portion 61.

The oil path 62 is designed so as to extend from the oil stocking portion 61 and intercommunicate with the compressing chambers 43 of the respective cylinder 41. During the suction process of the refrigerant, the oil 8 in the oil stocking portion is led to the compressing chambers 43.

Figure 4:
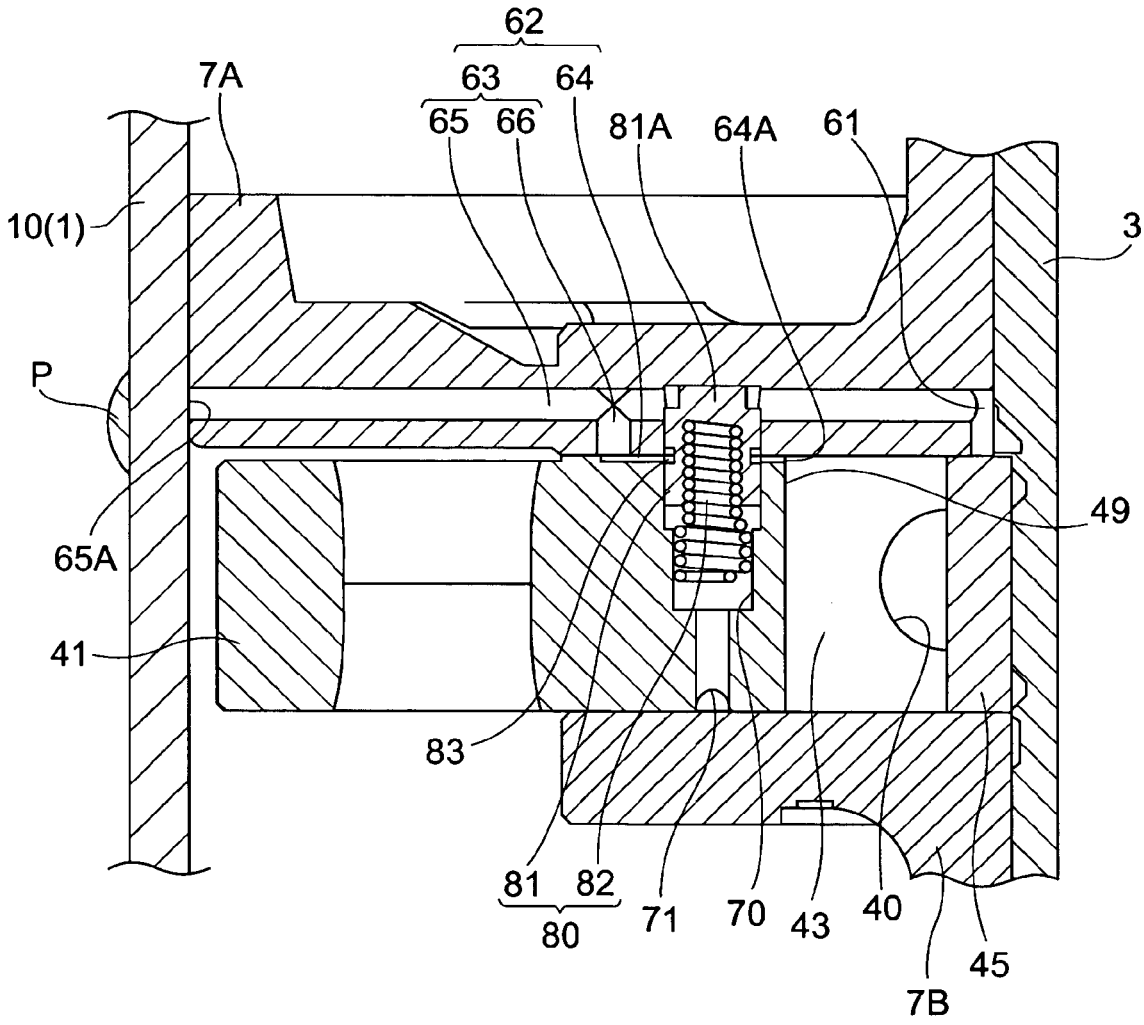
FIG. 4 is an enlarged longitudinally-sectional view showing an oil injecting portion and an opening/closing valve.

More specifically, the oil path 62 comprises an secondary oil path 63 formed in the primary bearing 7A as shown in FIG. 4, and a primary oil path 64 formed in the cylinder 41 so as to intercommunicate with the secondary oil path 63.

The secondary oil path 63 comprises a first oil path 65 penetrating from the outer peripheral surface of the primary bearing 7A to the oil stocking portion 61, and a second oil path 66 penetrating through the primary bearing 7A in the vertical direction (thickness direction) and intercommunicating with the first oil path 65. Accordingly, the oil 8 stocked in the oil stocking portion 61 is led to the primary oil path 64 of the cylinder 41 through the first oil path 65 and the second oil path 66.

When the primary bearing 7A is fixed to the hermetically sealed container 1 by carrying out tack-welding from the outside of the hermetically sealed container 1, the place P corresponding to the opening end 65A of the first oil path 65 at the outer peripheral surface side of the primary bearing 7A is tack-welded from the outside of the hermetically sealed container 1, whereby the opening end 65A can be closed in close contact with the inner surface of the hermetically sealed container 1 simultaneously with the fixing of the primary bearing 7A. Accordingly, the opening end 65A can be closed without separately using any member for closing the opening end 65A, so that the cost can be reduced and the fabrication working process can be simplified. When not the primary bearing 7A, but the cylinder 41 is fixed to the hermetically sealed container 1, the opening end 65A of the first oil path 65 may be closed by using plug or the like.

The primary oil path 64 is provided on the upper surface of the cylinder 41, and it is formed as a narrow groove so that one end thereof intercommunicates with the opening end of the second oil path 66 and the other end thereof extends so as to intercommunicate with the compression chamber 43. Accordingly, the oil 8 led from the secondary oil path 63 is led through the primary oil path 64 into the compression chamber 43. Furthermore, in connection with the suction of the refrigerant into the low-pressure chamber side 43A of the compression chamber 43, one end 64A of the primary oil path 64 is opened to the inner surface 49 of the cylinder of the low-pressure chamber side 43A as shown in FIG. 3 so that the oil 8 stocked in the oil stocking portion 61 is injected in the compression chamber 43.

That is, the refrigerant discharge pressure (for example, 3 MPa) is applied to the oil 8 in the hermetically sealed container 1. Accordingly, by opening one end 64A of the primary oil path 64 to the low-pressure chamber side 43*a*, the high-pressure oil 8 stocked in the oil stocking portion 61 is passed through the oil path 62 comprising the secondary oil path 63 and the primary oil path 64 by the differential pressure between the pressure of the oil 8 and the inner pressure (for example, 1.1 MPa) of the low-pressure chamber side 43A of the compression chamber 43 and led into the low-pressure chamber side 43A of the compression chamber 43 during the refrigerant suction process.

As a result, following the suction of the refrigerant into the compression chamber 43, the oil 8 is injected into the compression chamber 43. Therefore, sufficient oil film is formed between the cylinder inner surface 49 and the roller 45 by the oil 8 can be enhanced. Particularly, the oil is injected into the compression chamber 43 during the suction process of the refrigerant into the compression chamber 43, and the low-pressure chamber side 43A and the high-pressure chamber side 43B of the compression chamber 43 can be more surely separated from each other. Therefore, in the process that the refrigerant is fed to the high-pressure chamber side 43B and compressed (compression process), leakage of the compressed refrigerant into the low-pressure chamber side 43A can be prevented, and the refrigerant compression efficiency is enhanced, so that the cooling efficiency of the hermetically sealed rotary compressor 100 can be enhanced.

When one end 64A of the primary oil path 64 is formed to be opened at an angle in a predetermined angle range from $\theta 1$ to $\theta 2$ ($\theta 1$: 0°, $\theta 2$: 170°, more preferably $\theta 1$: 125°, $\theta 2$: 165°) with respect to a reference line L connecting the suction port 48 and the center point O of the cylinder 41A as shown in FIG. 3, the compression efficiency of the refrigerant (about 55° in the example of FIG. 3) can be further enhanced.

Here, the amount of the oil 8 injected into the compression chamber 43 can be adjusted by adjusting the cross-section area (opening area) D of the primary oil path opened to the inner surface 49 of the cylinder. According to this embodiment, in order to set the amount of the oil 8 injected into the compression chamber 43 to a proper amount, the cross-section area D of the primary oil path 64 is determined so that the ratio R (=D/V) of the cross-section area D of the primary oil path 64 and the displacement volume V of the compression chamber 43 falls within a predetermined range.

More specifically, if the ratio R is excessively small, the primary oil path 64 is excessively narrow and the oil 8 is not injected into the compression chamber 43. On the other hand, if the ratio R is excessively large, the oil 8 is excessively injected into the compression chamber 43 and thus liquid compression occurs. Therefore, according to this embodiment, the ratio R is set to fall in the range from 0.004 to 0.03 (mm.sup.2/cc), and the cross-sectional area D of the primary oil path 64 is determined on the basis of the ratio R, whereby the sealing performance between the inner surface 49 of the cylinder and the roller 45A is enhanced with preventing the liquid compression due to excessive injection of the oil 8.

The effect of enhancing the sealing performance by the oil injection into the compression chamber 43 is larger when the rotary compressing element 4 is rotated in a low frequency area (for example, 15 Hz to 30 Hz) and thus the differential pressure between the discharge pressure and the suction pressure is smaller than when the rotary compressing element 4 is rotated in a high frequency area and thus rotated at a high speed. That is, by limiting the oil injection into the compression chamber 43 to the time when the differential pressure is small, the cooling efficiency can be more effectively enhanced with suppressing wasting of the oil 8. Therefore, according to this embodiment, the oil path 62 is provided with an opening/closing valve 80, and the opening/closing valve 80 is set to an open state only when the rotary compression element 4 is rotated at a low speed and thus the differential pressure between the discharge pressure and the suction pressure is smaller, thereby injecting the oil 8 into the compression chamber 43.

The construction of the opening/closing valve 80 will be described. As shown in FIG. 4, a cylindrical through hole 70 which traverses from the first oil path 65 to the primary oil path 64 and extends to the lower surface of the cylinder 41 is provided in the cylinder 41, and the opening/closing valve 80 is provided in the through hole 70. The opening/closing valve 80 comprises a substantially cylindrical valve plug which is engagedly inserted in the through hole 70, and a spring 82 as an urging member for urging the valve plug 81 to the first oil path 65. The upper portion 81A of the valve plug 81 invades into the first oil path 65, and the pressure in the first oil path 65, that is, the discharge pressure is applied to the upper portion 81A. At this time, the upper portion 81A of the valve plug 81 is designed to be smaller in diameter than the through hole 70, so that the flow of the oil 8 can be secured even when the upper portion 81 A is located in the first oil path 65.

The narrow groove 83 is formed along the peripheral direction on the outer periphery of the valve plug 81, and when the valve plug 81 is set and kept to be pressed up to the first oil path 65 side by the spring 82, the primary oil path 64 which is disconnected by the upper portion 81A of the valve plug 81 in the through hole 70 is connected through the narrow groove 83 of the valve plug 81, and the oil injection into the compression chamber 43 is carried out.

Furthermore, as shown in FIG. 3, an intercommunicating rod 71 extending from the suction port 48 to the through hole 70 is formed on the lower surface of the cylinder 41, and the suction pressure of the refrigerant is led to the bottom portion of the through hole 70 through the intercommunicating rod 71. That is, the pressure in the first oil path 65 (that is, the discharge pressure of the rotary compressing element 4) is applied to the upper portion 81A of the valve plug 81, and the refrigerant suction pressure is applied to the inside of the valve plug 81.

Accordingly, during the period when the discharge pressure of the rotary compressing element 4 is low and thus the differential pressure of the discharge pressure from the suction pressure is small, the valve plug 81 is urged up to be located at the first oil path 65 by the urging force of the spring 82, and the primary oil path 64 is kept to be connected through the narrow groove 83 of the valve plug 81 to the one end portion 64A opened to the compression chamber 43, that is, the open state for oil injection is set. Furthermore, when the discharge pressure of the rotary compressing element 4 is increased and the differential pressure from the suction pressure is increased, the valve plug 81 is pressed down against the urging force of the spring 82, and the state that the narrow groove 83 of the valve plug 81 and the primary oil path 65 is disconnected from each other, that is, the close state is set. Under this close state, the oil path 62 is closed, and the injection of the oil 8 into the compression chamber 43 is stopped.

Accordingly, the oil injection into the compression chamber 43 is limited to the case where the rotary compressing element 4 is driven at a low frequency and thus the differential pressure between the discharge pressure and the suction pressure is small, and the cooling efficiency can be effectively enhanced with suppressing consumption of the oil 8 stocked in the heretically sealed container 1.

As described above, according to this embodiment, the oil 8 is injected into the compression chamber 43 when the refrigerant is sucked into the compression chamber 43. Therefore, sufficient oil film is formed between the cylinder 41 and the roller 45 by the oil 8 injected in the compression chamber 43, and thus the sealing performance can be enhanced. Accordingly, the refrigerant during the compression process can be prevented from leaking into the low-pressure chamber side 43A, and thus the compression efficiency is enhanced, so that the cooling efficiency of the hermetically sealed rotary compressor 100 can be enhanced.

Furthermore, according to this embodiment, the ratio between the cross-section area D of the primary oil path 64 constituting the oil path 62 and the displacement volume V of the compression chamber 43 is set to be within a predetermined range. Accordingly, the sealing performance between the cylinder inner surface 49 and the roller 45 can be enhanced with preventing the liquid compression due to excessive injection of the oil 8.

Still furthermore, according to this embodiment, the oil path 62 is provided with the opening/closing valve 80 which is set to the open state only when the discharge pressure of the rotary compressing element 4 is low, that is, in an area where the differential pressure between the discharge pressure and suction pressure of the rotary compressing element 4 is small. Therefore, the oil injection into the compression chamber 43 is limited to the time period when where the differential pressure between the discharge pressure and suction pressure of the rotary compressing element 4, whereby the cooling efficiency can be effectively enhanced with suppressing the consumption of the oil 8 stocked in the hermetically sealed container 1.

The above embodiment relates to the hermetically sealed rotary compressor 1 having one cylinder 41, however, the present invention my be applied to a hermetically sealed rotary compressor having two or more compressors.

Second Embodiment

Figure 5:
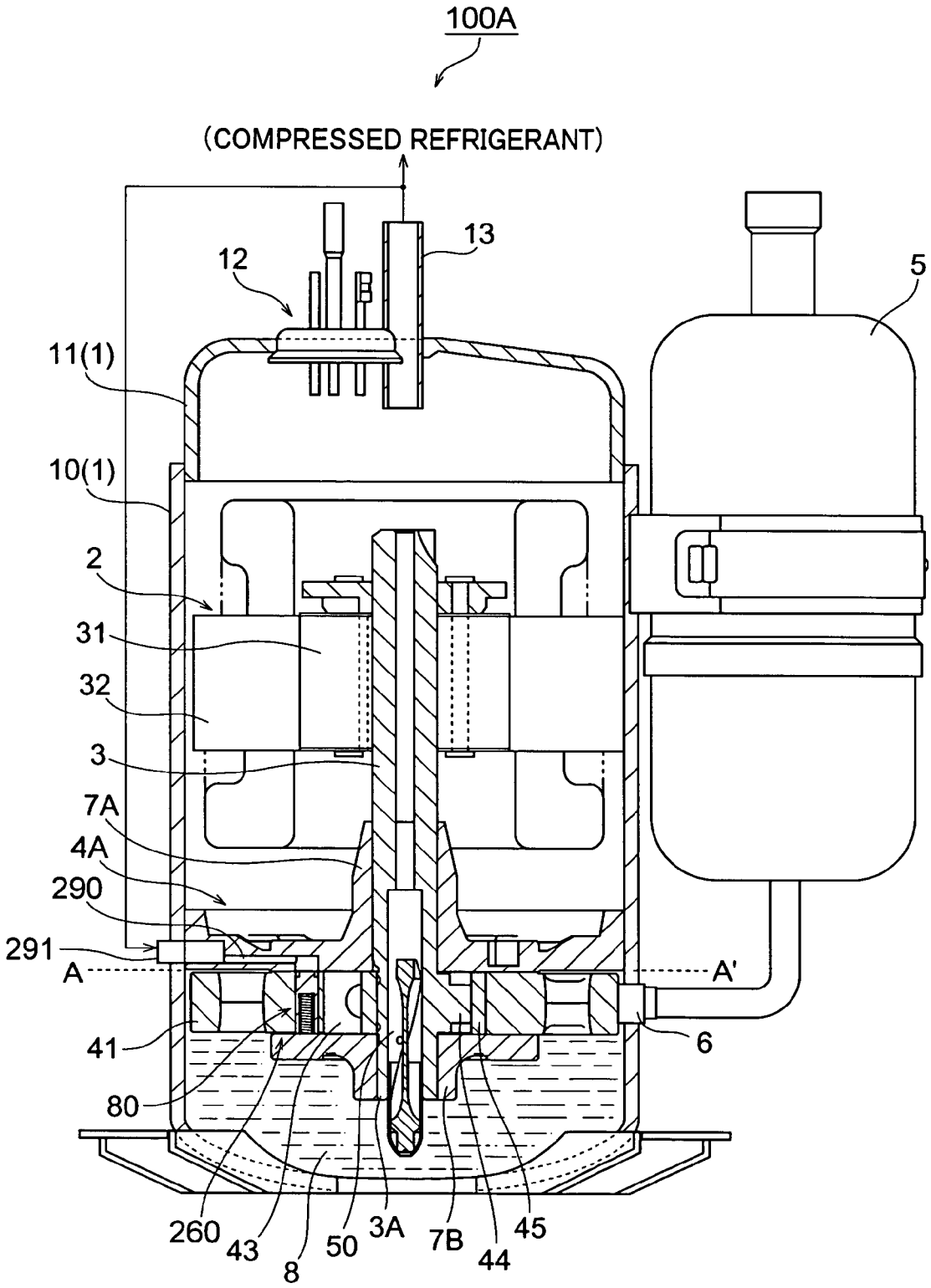
FIG. 5 is a longitudinally-sectional view showing the construction of a hermetically sealed rotary compressor according to a second embodiment of the present invention.
Figure 6:
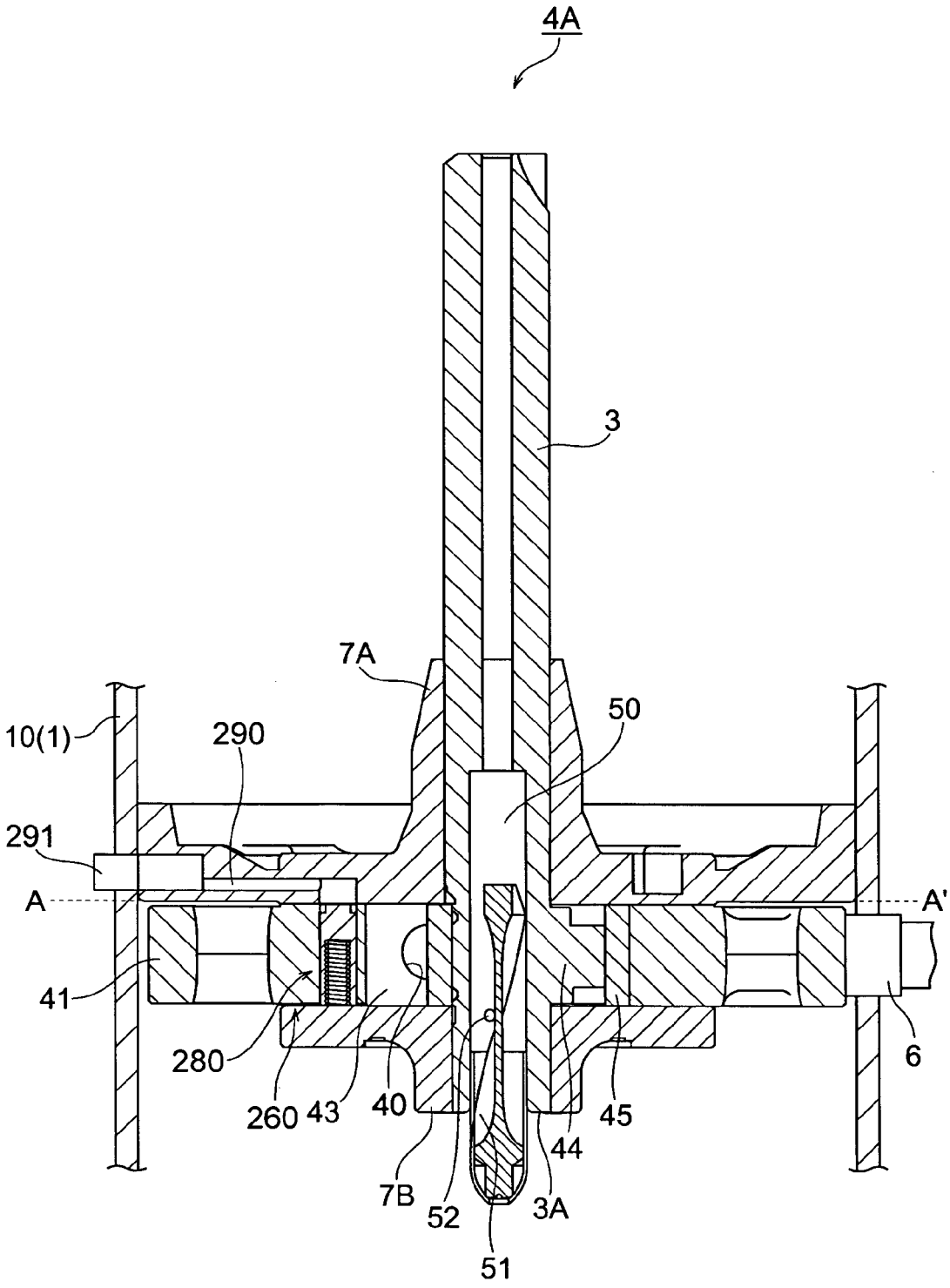
FIG. 6 is an enlarge longitudinally-sectional view showing a rotary compressing element.

FIG. 5 is a longitudinally-sectional view showing a hermetically sealed rotary compressor according to a second embodiment of the present invention, and FIG. 6 is an enlarged longitudinally-sectional view showing a rotary compressing element. The hermetically sealed rotary compressor 100A constitutes a refrigerating unit by connecting a refrigerant condenser and a refrigerant evaporator through a pipe. As in the case of the hermetically sealed rotary compressor 100, as shown in FIG. 5, the hermetically sealed rotary compressor 100A has a hermetically sealed container 1, an electrically-driven element 2 is accommodated at the upper side of the hermetically sealed container 1, and a rotary compressing element 4 that is driven by a crank shaft 3 of the electrically-driven element 2 to compress the refrigerant is accommodated at the lower side of the hermetically sealed container 1.

As shown in FIGS. 5 and 6, the hermetically rotary compressor 100A of this embodiment has the same basic construction as the fist embodiment. Therefore, the same elements as the first embodiment are represented by the same reference numerals and the description thereof is omitted.

The hermetically sealed rotary compressor 100A of this embodiment is designed so that the oil 8 is injected into the compression chamber 43 when the refrigerant is sucked into the compression chamber 43 in order to enhance the refrigerant compression efficiency as in the case of the first embodiment. The construction of the hermetically sealed rotary compressor 100A will be specifically described.

Figure 8:
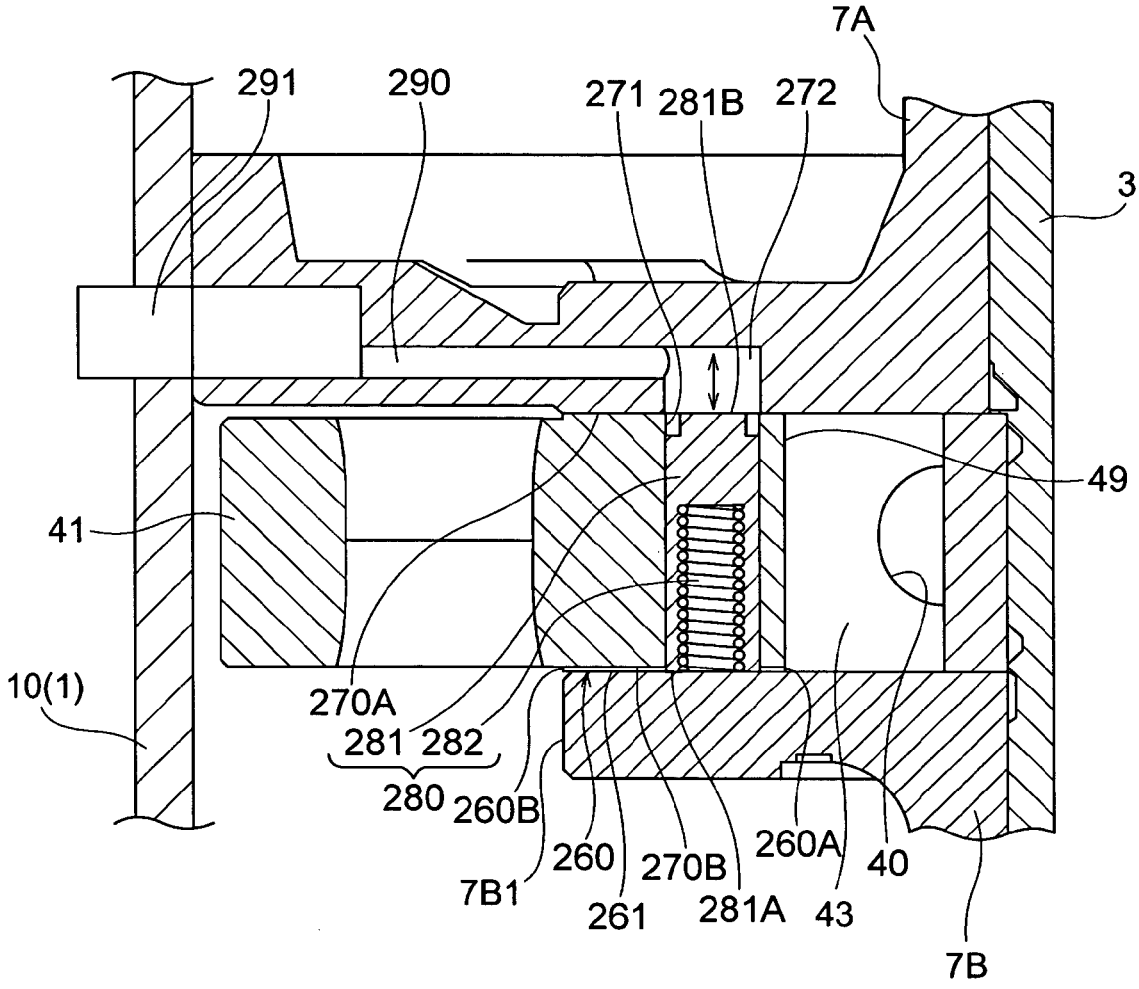
FIG. 8 is an enlarged longitudinally-sectional view showing a oil path and an opening/closing valve.

As shown in FIG. 8, step portions 270A, 270B are formed within the contact faces with the primary bearing 7A and the secondary bearing 7B on the upper and lower surfaces of the cylinder 41 to enhance the close contact.

A groove 261 extending in the radial direction is formed on the step portion 270B at the lower side, that is, on the lower surface of the cylinder 41 making the contact with the secondary bearing 7B by cutting work, and when the step portion 270B and the secondary bearing 7B are brought into close contact with each other, an oil path 260 is formed so that one end 260A is opened to the inner surface 49 of the cylinder 41 by the groove 261 and the other end 260B thereof is opened to the oil 8 stocked in the hermetically sealed container 1. When the oil 8 is stocked in the hermetically sealed container 1 to the extent that the primary bearing 7B is immersed in the oil 8, the groove 261 may be formed on the step portion 270A at the upper side, that is, on the upper surface of the cylinder 41 coming into contact with the primary bearing 7A, thereby forming the oil path 260.

Figure 7:
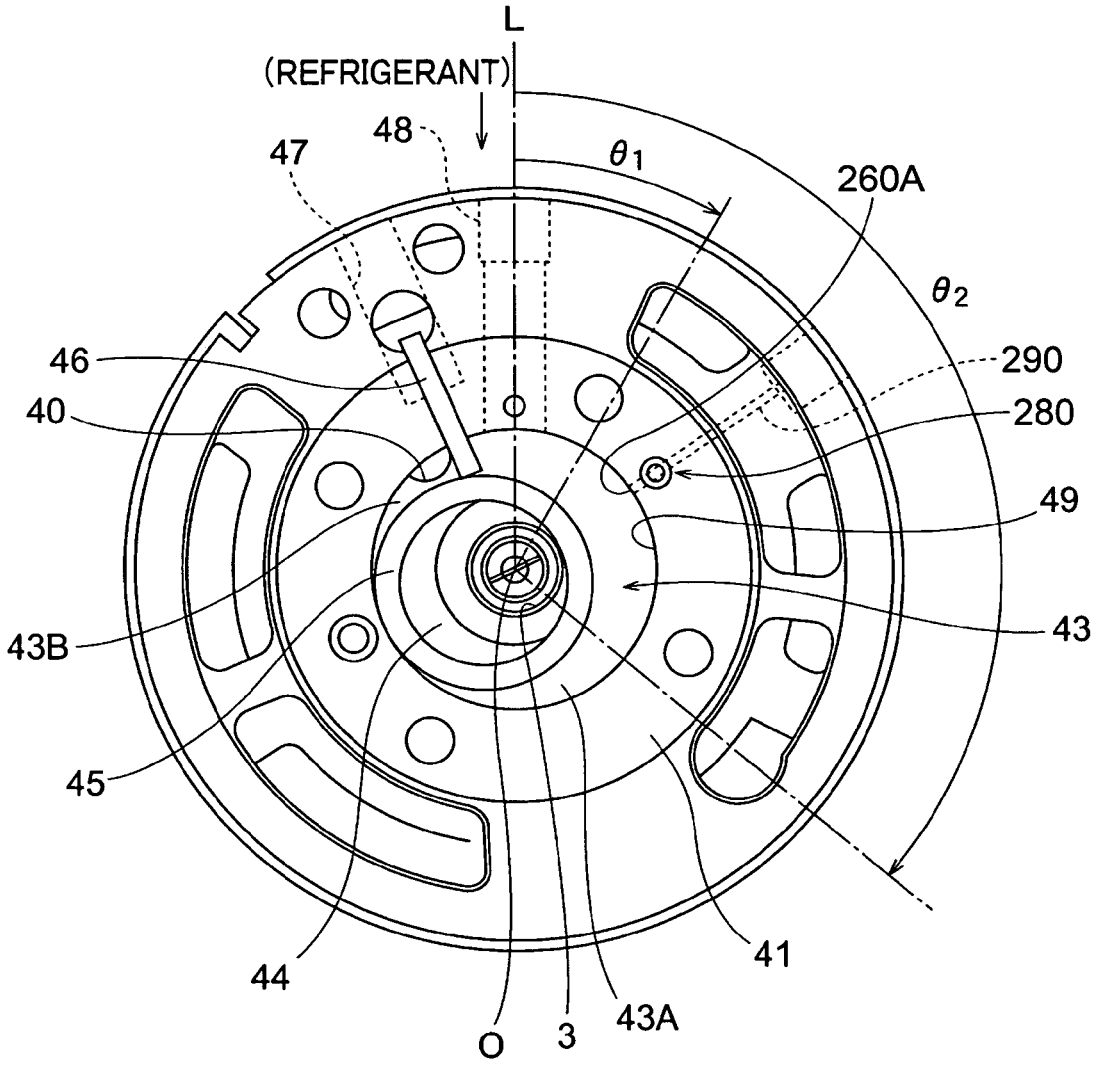
FIG. 7 is a plan view showing a cylinder.

One end 260A of the oil path 260 is opened to the cylinder inner surface 49 of the low-pressure chamber side 43A so that the oil 8 can be injected into the compression chamber 43 in connection with the suction of the refrigerant into the compression chamber 43. Particularly, as shown in FIG. 7, the one end 260A of the oil path 260 is opened at an angle in a predetermined angle range from θ1 to θ2 (θ1: 0°, θ2: 170°, more preferably θ1: 125°, θ2: 165°) with respect to a reference line L connecting the suction port 48 and the center point O of the cylinder 41 (about 55° in the example of FIG. 7) can be further enhanced.

That is, since the refrigerant discharge pressure (for example, 3 MPa) is applied to the oil 8 in the hermetically sealed container 1, by opening the one end 260A of the oil path 260 to the cylinder inner surface of the low-pressure chamber side 43A, the high-pressure oil 8 is passed through the oil path 260 and injected into the low-pressure chamber 43A of the compression chamber 43 of the cylinder 43 by the differential pressure from the inner pressure (for example, 1.1 MPa) of the low-pressure chamber 43 of the compression chamber 43.

Accordingly, sufficient oil film is formed between the cylinder inner surface 49 and the roller 45 by the oil 8 injected into the compression chamber 43, and the sealing performance is enhanced by the oil film. Particularly, the oil 8 is injected into the compression chamber 43 during the suction process of the refrigerant into the compression chamber 43, and the low-pressure chamber side 43A and the high-pressure chamber side 43B of the compression chamber 43 are more surely separated from each other. Therefore, in the process of compressing the refrigerant to the high-pressure chamber side 43B (compression process), the leakage of the compressed refrigerant to the low-pressure chamber side 43A can be prevented, and the refrigerant compression efficiency is enhanced, so that the cooling efficiency of the hermetically sealed rotary compressor 100A can be enhanced.

Here, in this embodiment, by adjusting the cross-section area D of the oil path 260 opened to the cylinder inner surface 49 (that is, the cross-section area of the groove 261), the amount of the oil injected into the compression chamber 43 is adjusted, and at this time the cross-section area D of the oil path 260 is determined so that the ratio R (=D/V) between the cross-section area D of the oil path 260 and the displacement volume V of the compression chamber 43 falls within a predetermined range. Specifically, when the ratio R is excessively small, the oil path 260 is excessively narrow, and thus no oil 8 is injected into the compression chamber 43. On the other hand, when the ratio R is excessively large, the oil 8 is excessively injected into the compression chamber 43, and thus liquid compression occurs. Therefore, it is preferable that the ratio R is set to fall within the range from 0.004 to 0.03 ($mm^2/cc$), whereby the sealing performance between the cylinder inner surface 49 and the roller 45 can be enhanced with preventing liquid compression due to excessive injection of the oil 8.

The sealing effect based on the oil injection into the compression chamber 43 is larger when the rotary compressing element 4 is driven in a low frequency area (for example, 15 Hz to 30 Hz) and thus the differential pressure between the discharge pressure and the suction pressure is small than when the rotary compressing element 4 is driven in a high frequency area and thus rotated at a high speed. That is, by limiting the oil injection into the compression chamber 43 to the case where the differential pressure is small, the cooling efficiency can be effectively enhanced with suppressing the wasting of the oil 8 stocked in the hermetically sealed container 1. Therefore, according to this embodiment, an opening/closing valve 280 is provided to the oil path 260, and only when the pressure of the refrigerant compressed by the rotary compressing element 4 is relatively small, that is, the discharge pressure of the rotary compressing element 4 is small, the opening/closing valve 280 is set to the open state, so that the oil 8 is injected into the compression chamber 43.

The construction of the opening/closing valve 280 will be described in detail. The cylinder 41 is provided with a cylindrical through hole 271 which penetrates through the cylinder 41 in the vertical direction (thickness direction) and traverses the oil path 260, and the opening/closing valve 280 described above is provided in the through hole 271. The opening/closing valve 280 comprises a substantially cylindrical valve plug 281 engagedly inserted in the through hole 271, and a spring 282 as an urging member that is provided in the valve plug 281 and urges the valve plug 281 to the primary bearing. Under the state (open state) that valve plug 281 is pushed up to the primary bearing 7A side by the urging force of the spring 282, a gap occurs between the bottom portion 281A of the valve plug 281 and the upper surface of the secondary bearing 7B, and the oil path 260 disconnected by the through hole 271 is connected, so that the oil is injected into the compression chamber 43.

Furthermore, the primary bearing 7A is provided with a recess portion 272 in conformity with the through hole 271. When the valve plug 281 is pushed up by the spring 282, the upper portion 281B of the valve plug 281 abuts against the upper surface of the recess portion 272. One end of a compressed refrigerant introducing path 290 provided in the primary bearing 7A is connected to the recess portion 272, and the other end of the compressed refrigerant introducing path 290 is connected to an introducing pipe 291 which is fixed to the hermetically sealed container 1 so as to penetrate through the hermetically sealed container 1. As shown in FIG. 5, a part of the compressed refrigerant discharged from the discharge pipe 13 of the hermetically sealed container 1 is led into the introducing pipe 291 through a connection pipe. Therefore, the pressure of the compressed refrigerant is applied to the upper portion 281 of the valve plug 281 through the compressed refrigerant introducing path 290. Furthermore, when the spring constant (urging force) of the spring 282 is determined so that the valve plug 281 is pushed down when the differential pressure between the pressure of the compressed refrigerant and the suction pressure is equal to a predetermined value or more.

Accordingly, during the time period when the differential pressure of the compressed refrigerant is small, the valve plug 282 is pushed up to the primary bearing 7A side by the urging force of the spring 282, and the oil path 260 is set to a communicating state (connected state), that is, it is set to an open state. When the pressure of the compressed refrigerant is enhanced and the differential pressure of the pressure of the compressed refrigerant from the suction pressure thereof is increased, the valve plug 281 is pushed down against the urging force of the spring 282 by the pressure of the compressed refrigerant, and the oil path 260 is closed by the bottom portion 281A of the valve plug 281, so that the injection of the oil 8 into the compression chamber 43 is stopped.

Accordingly, the oil injection into the compression chamber 43 is limited to the time period when the rotary compressing element 4 is driven at a low frequency and thus the compressed refrigerant pressure is small, that is, the differential pressure between the discharge pressure and the suction pressure of the rotary compressing element 4 is small, so that the cooling efficiency can be effectively enhanced with suppressing wasting of the oil 8 stocked in the hermetically sealed container 1.

As described above, according to this embodiment, the oil 8 is injected into the compression chamber 43 during the suction process of the refrigerant into the compression chamber 3 as in the case of the first embodiment. Therefore, the sufficient oil film is formed between the cylinder 41 and the roller 45 by the oil 8 injected into the compression chamber 43 and thus the sealing performance can be enhanced. Accordingly, the leakage of the refrigerant into the low-pressure chamber side 43A during the compression process in the compression chamber 43 can be prevented, and thus the compression efficiency can be enhanced, so that the cooling efficiency of the hermetically sealed rotary compressor 100A can be enhanced.

Furthermore, according to this embodiment, the ratio between the cross-section area D of the oil path 260 for injecting the oil 8 into the compression chamber 43 and the displacement volume V of the compression chamber 43 is set to be within a predetermined range, whereby the sealing performance between the cylinder inner surface 49 and the roller 45 can be enhanced with preventing the liquid compression due to excessive injection of the oil 8.

Furthermore, according to this embodiment, the oil path 262 is provided with the opening/closing valve 280 that is set to the open state only when the pressure of the compressed refrigerant is small, that is, during only the time period when the rotary compressing element 4 is driven in an area where the differential pressure between the discharge pressure and suction pressure of the rotary compressing element 4 is small. Therefore, the oil injection into the compression chamber 43 is limited to the time period when the differential pressure between the discharge pressure and the suction pressure of the rotary compressing element 4 is small, and thus the cooling efficiency can be effectively enhanced with suppressing wasting of the oil 8 stocked in the hermetically sealed container 1.

In this embodiment, the hermetically sealed rotary compressor 100A having one cylinder 41 is used. However, the present invention is not limited to this type of hermetically sealed rotary compressor 100A, and it may be applied to a hermetically sealed rotary compressor having two or more cylinders.

Third Embodiment

Figure 9:
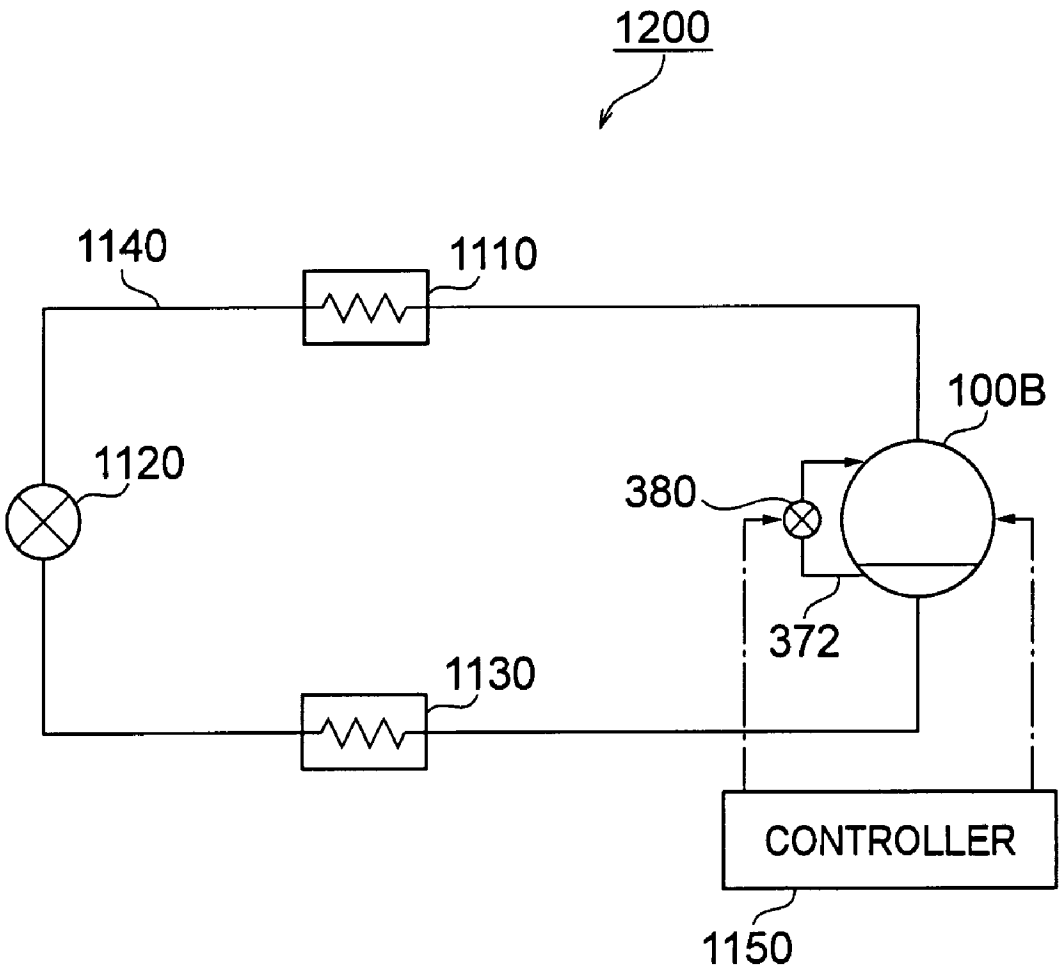
FIG. 9 is a diagram showing a refrigerating circuit according to a third embodiment of the present invention.

FIG. 9 is a diagram showing the construction of a refrigerating circuit 1200 according to an embodiment. As shown in FIG. 9, the refrigerating circuit 1200 (refrigerating cycle) comprises a hermetically sealed rotary compressor 100B, a condenser 1110, an expansion valve 1120 and an evaporator 1130 that are connected to one another in this order through a refrigerant pipe 1140. In this refrigerating circuit 1200, high-temperature and high-pressure gas refrigerant compressed in the hermetically sealed rotary compressor 100B radiates heat in the condenser 1110 and is condensed and liquefied. The refrigerant thus liquefied is reduced in pressure by the expansion valve 1120, and absorbs heat from the outside heat in the evaporator 1130 to thereby cool the surrounding of the evaporator 1130. Thereafter, the liquefied refrigerant is stocked in an accumulator (not shown), and the gas refrigerant is returned to the hermetically sealed rotary compressor 100B.

Figure 10:
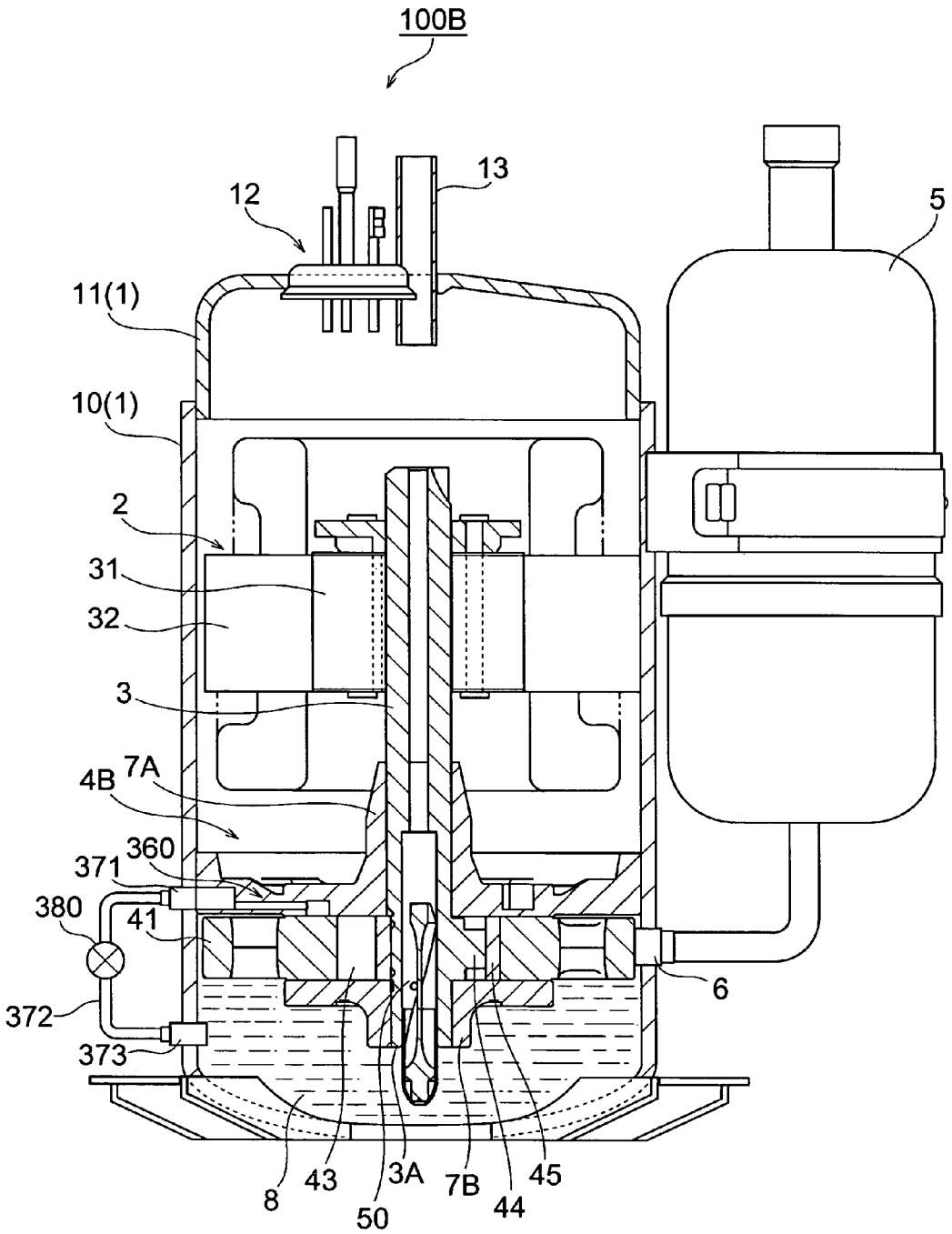
FIG. 10 is a longitudinally-sectional view showing an example of the hermetically sealed rotary compressor according to this embodiment.
Figure 11:
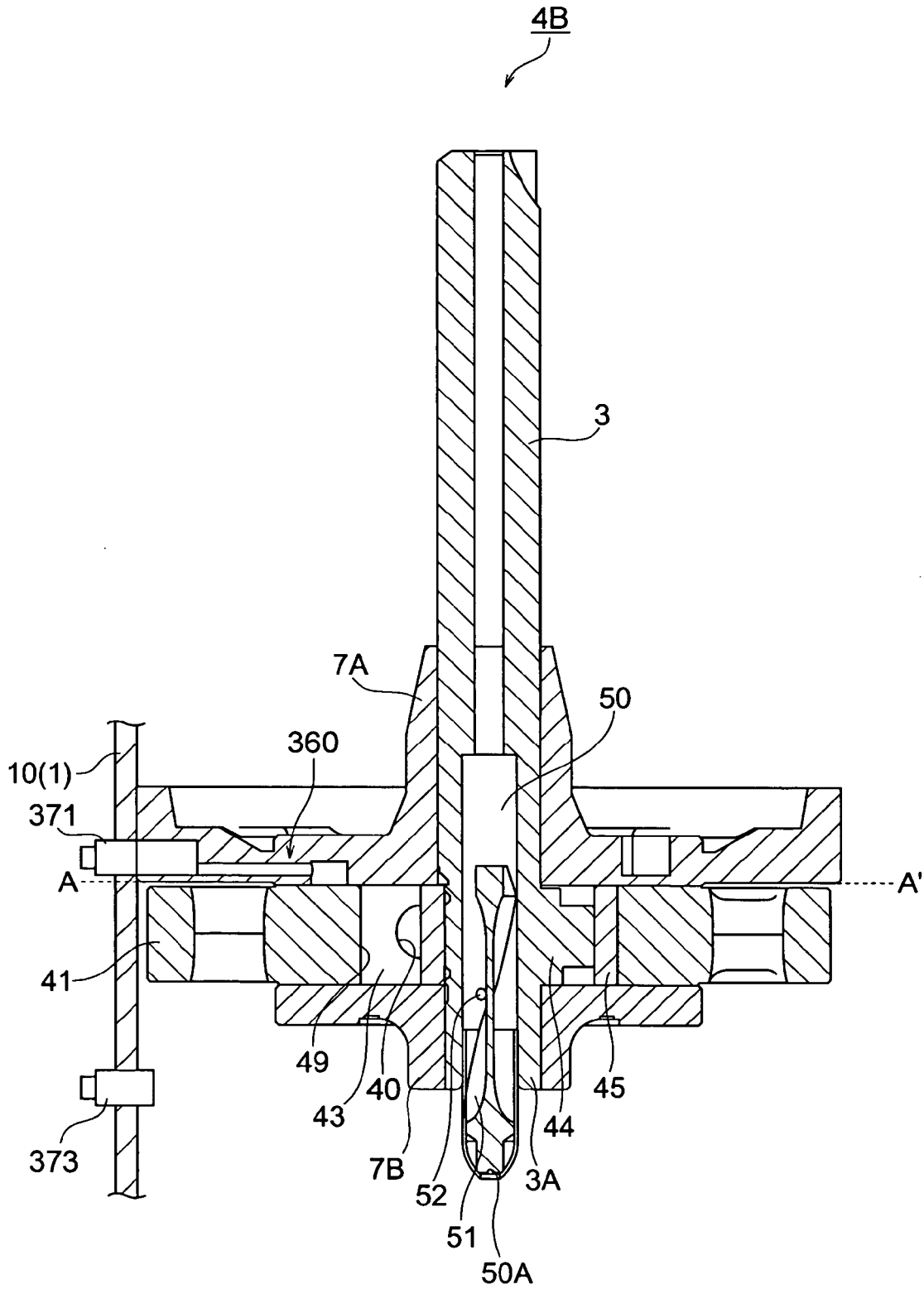
FIG. 11 is an enlarged longitudinally-sectional view showing the rotary compressing element.

FIG. 10 is a longitudinally sectional view showing an example of the hermetically sealed rotary compressor 100B according to this embodiment, and FIG. 11 is an enlarged longitudinally-sectional view showing a rotary compressing element. The hermetically sealed rotary compressor 100B constitutes a refrigerating unit by connecting a condenser and an evaporator for refrigerant to each other through a pipe. As shown in FIG. 10, as in the case of the first and second embodiments, the hermetically sealed rotary compressor 100B has hermetically sealed container 1. An electrically-driven element 2 is accommodated at the upper portion of the hermetically sealed container 1, and a rotary compressing element 4 that is driven by the crank shaft 3 of the electrically-driven element 2 to compress the refrigerant is accommodated at the lower portion of the hermetically sealed container 1. The basic construction of the hermetically sealed rotary compressor 100B of this embodiment is the same as the first and second embodiments. Therefore, the same elements as the first and second embodiments are represented by the same reference numerals, and the description thereof is omitted.

In order to enhance the compression efficiency of the refrigerant, the hermetically sealed rotary compressor 100B of this embodiment is equipped with an oil path 360 for injecting the oil 8 into the compression chamber 43 when the refrigerant is sucked into the compression chamber 43. The construction of the hermetically sealed rotary compressor 100B will be described in detail.

Figure 13:
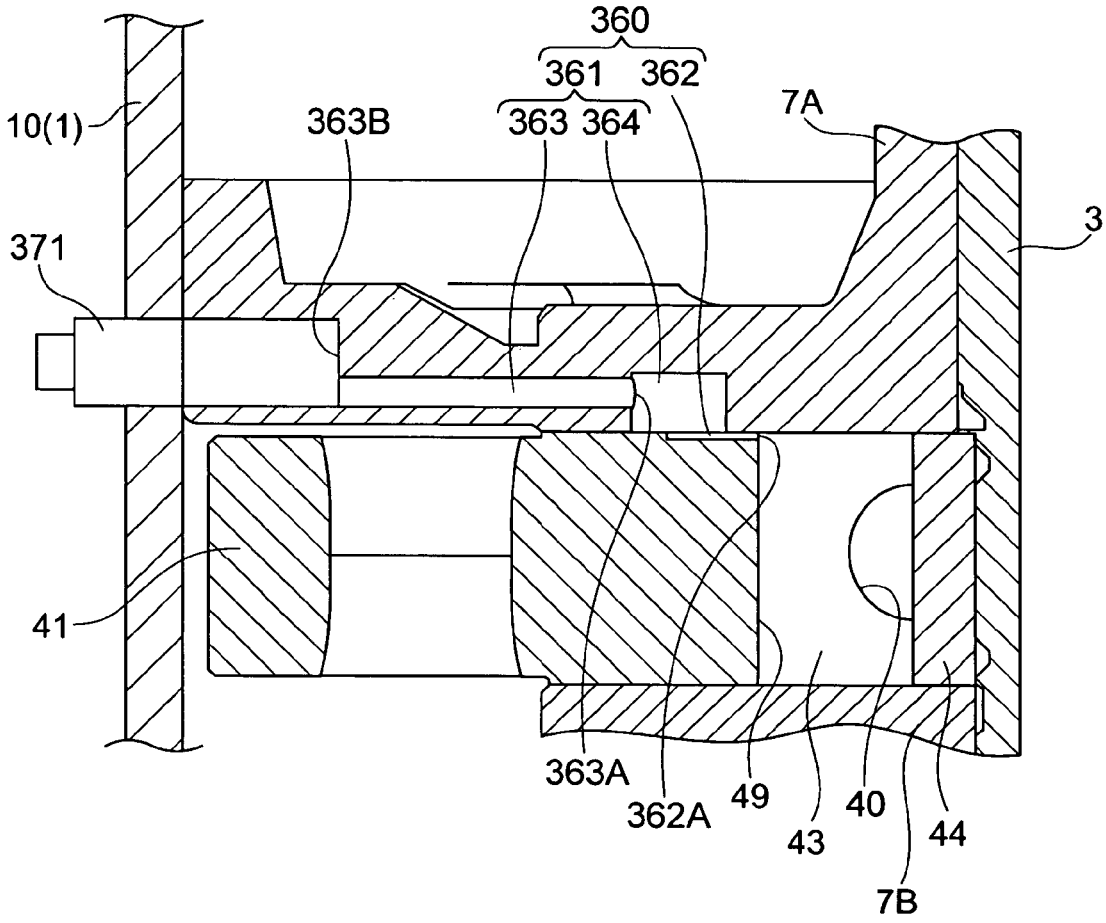
FIG. 13 is an enlarged longitudinally-sectional view showing an oil path.

As shown in FIG. 13, the oil path 360 comprises a secondary oil path 361 formed in the primary bearing 7A, and a primary oil path 362 formed in the cylinder 41.

The secondary oil path 361 comprises a lateral hole extending from the outer peripheral surface of the primary bearing 7A to the crank shaft 3 side, and a recess portion 364 connected to one end portion 363A of the lateral hole 363 which is located at the crank shaft 3 side.

Furthermore, an introducing pipe 371 fixed to the hermetically sealed container 1 is connected to the other end portion 363B of the lateral hole 363 which is located at the primary bearing 7A side. As shown in FIG. 10, one end of an oil supply pipe 372 is connected to the introducing pipe 371. The other end of the oil supply pipe 372 is connected to a lead-out pipe 373 fixed to the bottom portion of the hermetically sealed container 1. Accordingly, the oil 8 stocked in the hermetically sealed container 1 is supplied through the oil supply pipe 372 to the secondary oil path 361.

Figure 12:
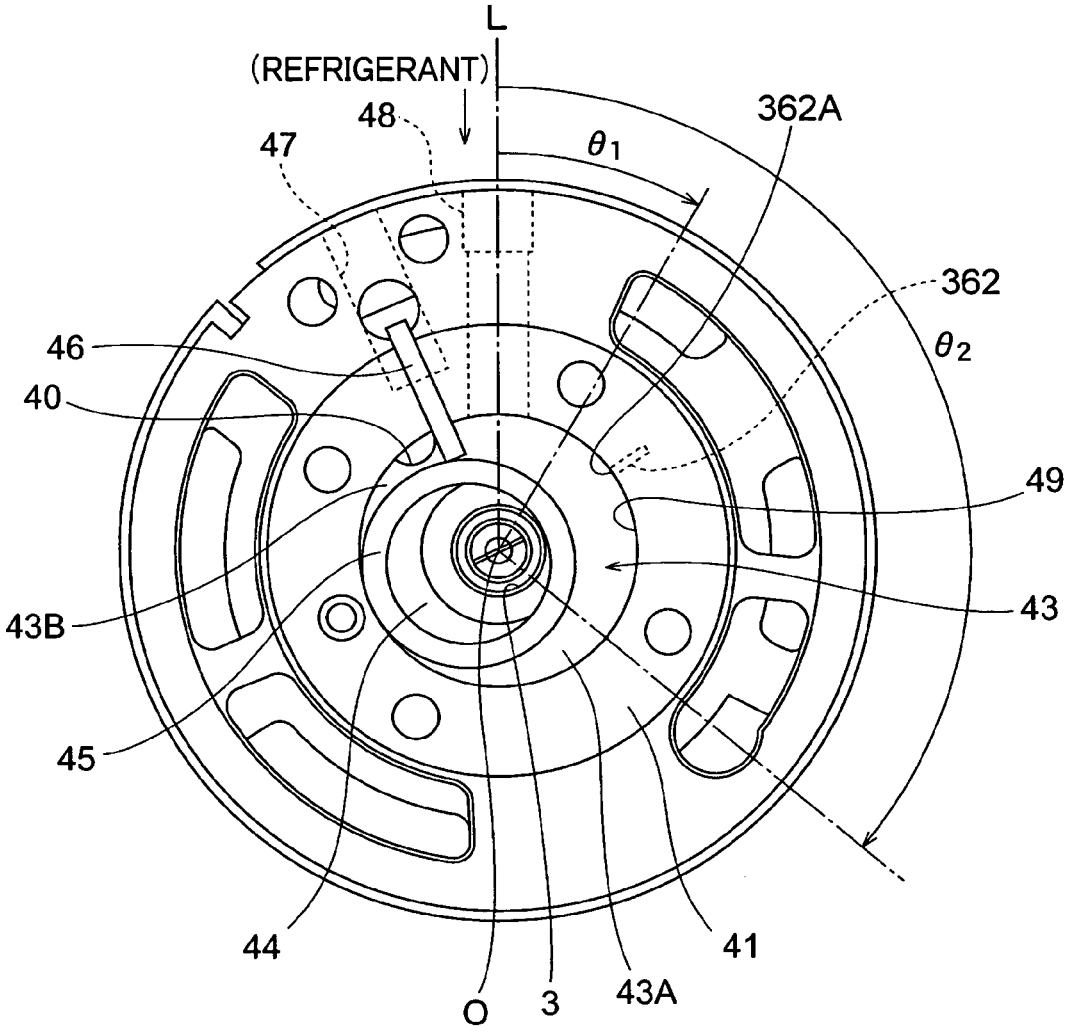
FIG. 12 is a plan view showing a cylinder.

Furthermore, as shown in FIG. 13, the primary oil path 362 is designed as a narrow groove extending so that one end thereof intercommunicates with the opening end of the recess portion 634 formed in the primary bearing 7A and the other end thereof intercommunicates with the compression chamber 343, and the oil 8 introduced to the secondary oil path 361 is passed through the primary oil path 362 and led into the compression chamber 43. In order to enable the oil 8 to be injected into the compression chamber 43 in connection with the suction of the refrigerant into the low-pressure chamber side 43A of the compression chamber 43, one end 362A of the primary oil path 362 is opened to the cylinder inner surface 49 of the low-pressure chamber side 43A as shown in FIG. 12.

That is, the refrigerant discharge pressure (for example, 3 MPa) is applied to the oil 8 in the hermetically sealed container 1. Therefore, by opening one end 362A of the primary oil path 362 to the cylinder inner surface 49 of the low-pressure chamber side 43A, the high-pressure oil 8 is supplied through the oil supply pipe 372 to the oil path 360 by the differential pressure between the pressure of the high-pressure oil 8 and the inner pressure (for example, 1.1 MPa) of the low-pressure chamber side 43A of the compression chamber 43, and injected from the oil path 360 into the low-pressure chamber side 43A of the compression chamber 43 of the cylinder 41.

As a result, the oil 8 is injected into the compression chamber 43 in connection with the suction of the refrigerant into the compression chamber, and thus sufficient oil film is formed between the cylinder inner surface 49 and the roller 45 by the oil 8 and the sealing performance is enhanced.

Accordingly, the low-pressure chamber side 43A and the high-pressure chamber side 43B are more surely separated from each other in the compression chamber 43 of the cylinder 41. Therefore, in the process (compression process) that the refrigerant sucked in the low-pressure chamber side 43A is fed to the high-pressure chamber side 43B and compressed, the leakage of the compressed refrigerant into the low-pressure chamber side 43A is prevented, and the refrigerant compression coefficient is enhanced, so that the cooling efficiency of the hermetically sealed rotary compressor 100B is enhanced.

As shown in FIG. 12, by forming the oil path 360 so that one end 360A thereof is opened at an angle in a predetermined angle range from θ1 to θ2 (θ1: 0°, θ2: 170°, more preferably θ1: 125°, θ2: 165°) with reference to a reference line L connecting the suction port 48 and the center point O of the cylinder 41, whereby the refrigerant compression efficiency can be further enhanced (in this example, about 125°).

Furthermore, according to this embodiment as in the case of the first embodiment, the cross-section area (opening area) D of the primary oil path 362 is set so that the ration R (=D/V) between the cross-section area D and the displacement volume V of the compression chamber 43 falls within a predetermined range, for example, within the range from 0.004 to 0.03 ($mm^2/cc$). Accordingly, the sealing performance between the cylinder inner surface 49 and the roller 45 is enhanced with preventing liquid compression due to excessive injection of the oil 8.

The effect of the sealing performance based on the oil injection into the compression chamber 43 is larger when the rotary compressing element 4 is driven in a low frequency area (for example, 15 Hz to 30 Hz) and thus the differential pressure between the discharge pressure and the suction pressure is small than when the rotary compressing element 4 is driven in a high frequency area and thus rotated at a high speed. That is, the oil injection into the compression chamber 43 is limited to the time period when the differential pressure is small, so that the cooling efficiency can be effectively enhanced with suppressing the wasting of the oil 8 stocked in the hermetically sealed container 1.

Therefore, in this embodiment, the electromagnetic valve 380 is inserted in the oil supply pipe 372 as shown in FIGS. 9 and 10, and a controller 1150 for controlling the driving of the hermetically sealed rotary compressor 100B controls the opening/closing operation of the electromagnetic valve 380 on the basis of the driving frequency of the rotary compressing element 4B. The controller 1150 sets the electromagnetic valve 380 to the open state only when the electrically-driven element 2 is driven in a low frequency area (for example, 15 Hz to 30 Hz), that is, only when the differential pressure between the discharge pressure and the suction pressure is small.

Accordingly, the oil injection into the compression chamber 43 is limited to only the case where the hermetically sealed rotary compressor 100B is driven at a low frequency, that is, the differential pressure between the discharge pressure and the suction pressure of the rotary compressing element 4B is small, and thus the cooling efficiency can be effectively enhanced with suppressing the wasting of the oil 8 stocked in the hermetically sealed container 1.

As described above, according to this embodiment, as in the case of the first and second embodiments, the oil 8 is injected into the compression chamber 43 during the suction process of the refrigerant into the compression chamber 43, so that the sufficient oil film is formed between the cylinder 41 and the roller 45 by the oil 8 injected in the compression chamber and the sealing performance is enhanced. Accordingly, the leakage of the refrigerant into the low-pressure chamber side 43A during the compression process in the compression chamber 43 can be prevented, and thus the compression efficiency is enhanced, so that the cooling efficiency of the hermetically sealed rotary compressor 100B can be enhanced.

Furthermore, according to this embodiment, the ratio between the cross-section area D of the oil path 360 for injecting the oil 8 into the compression chamber 43 and the displacement volume V of the compression chamber 43 is set to be within a predetermined range. Therefore, the sealing performance between the cylinder inner surface 49 and the roller 45 can be enhanced with preventing the liquid compression due to excessively injection of the oil 8.

Furthermore, according to this embodiment, the oil supply pipe 372 is provided with the opening/closing valve 380 that is set to the open state only when the rotary compressing element 4B is driven in a low frequency area, that is, only when the rotary compressing element 4B is driven in an area where the differential pressure between the discharge pressure and the suction pressure of the rotary compressing element 4B is small. Therefore, the oil injection into the compression chamber 43 is limited to the time period when the rotary compressing element 4B is driven at a low frequency and the differential pressure is low. Therefore, the cooling efficiency can be effectively enhanced with suppressing the wasting of the oil 8 stocked in the hermetically sealed container 1.

Figure 14:
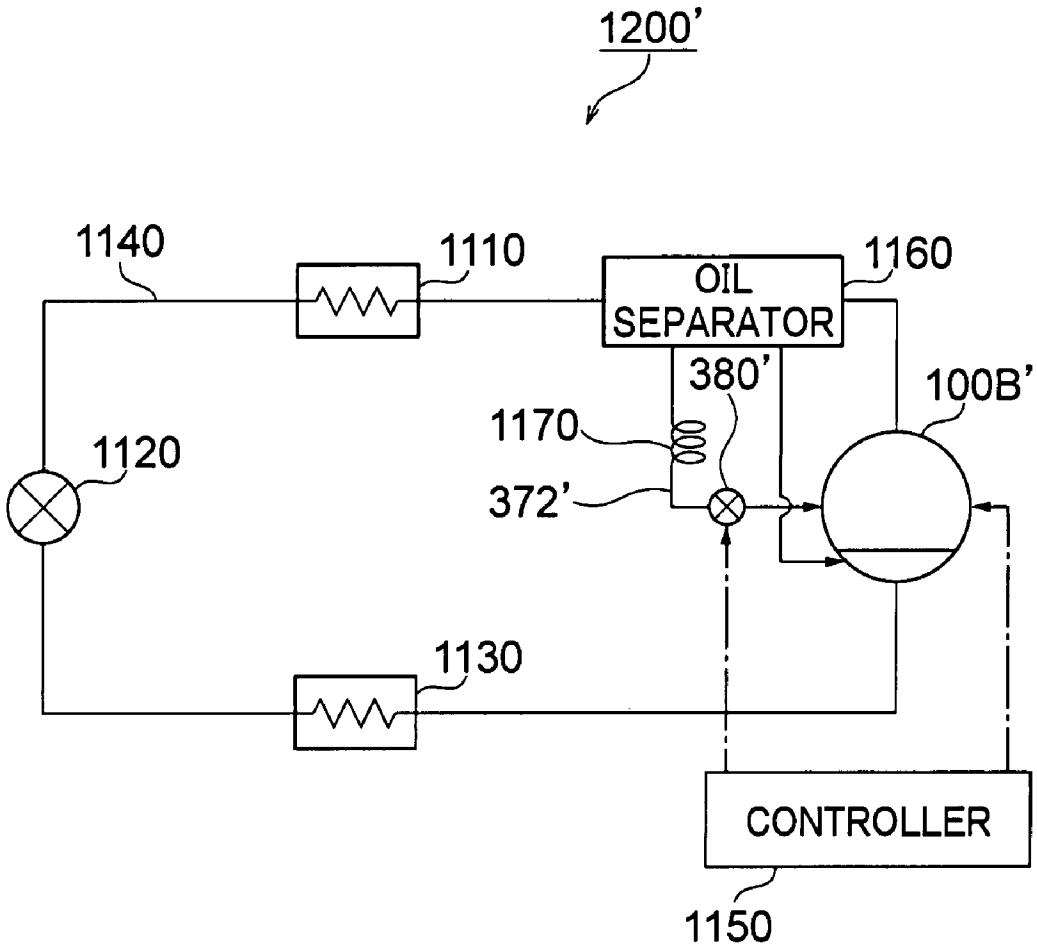
FIG. 14 is a diagram showing a refrigerating circuit according to a modification of the present invention.

Furthermore, according to this embodiment, the high-pressure oil 8 stocked in the hermetically sealed container 1 is injected into the compression chamber 43. However, the present invention is not limited to this embodiment, and oil of high pressure or middle pressure may be lead from the outside of the hermetically sealed rotary compressor and injected into the compression chamber 43. Specifically, as shown in FIG. 14, in a refrigerating circuit 1200', an oil separator 1160 for separating and withdrawing the oil from the refrigerant and returning the oil to the hermetically sealed rotary compressor 100B' is inserted between the discharge side of the hermetically sealed rotary compressor 100B' and the condenser 1110', the oil separator 1160 and the oil path 360 are connected to each other through an oil supply pipe 372' and a part of the oil withdrawn by the oil separator 1160 is supplied to the oil path 360. In this case, as in the case of the above-described embodiment, an electromagnetic valve 380' is provided to the oil supply pipe 372', and the electromagnetic valve 380' is set to the open state only when the rotary compressing element 4B of the hermetically sealed rotary compressor 100B' is driven in a low frequency area, and the oil is supplied to the oil path 360. There is a case where the oil supply pipe 372' is closed by the electromagnetic valve 380', and thus it is preferable that an oil return pipe is provided between the oil separator 1160 and the hermetically sealed rotary compressor 100B' separately from the oil supply pipe 372' in order to stably return the oil withdrawn by the oil separator 1160 to the hermetically sealed rotary compressor 100B'. Furthermore, the oil led from the oil separator 1160 is kept to be under high pressure, and thus it is preferable that a pressure-reducing unit such as a capillary tube 1170 (may be expansion valve) or the like is provided between the oil separator 1160 and the electromagnetic valve 380' to reduce and adjust the pressure of the oil and supply the pressure-adjusted oil to the oil path 360.

Furthermore, according to this embodiment, the hermetically sealed rotary compressor 100B is equipped with one cylinder 41. However, the present invention is not limited to this embodiment, and the present invention may be applied to a hermetically sealed rotary compressor having two or more cylinders.

What is claimed is:

1. A hermetically sealed compressor comprising:

an electrically-driven element;

a rotary compressing element driven by the electrically-driven element to compress refrigerant; the rotary compressing element having a primary bearing, a secondary bearing and at least one cylinder that is sandwiched between the primary and secondary bearings and has a refrigerant inlet through which a refrigerant is adapted to flow under refrigerant suction pressure and a discharge outlet through which compressed refrigerant is adapted to flow under refrigerant discharge pressure and including a compression chamber in which the refrigerant is compressed;

a hermetically sealed container in which the electrically-driven element and the rotary compressing element are accommodated and oil is stocked, a refrigerant suction path for sucking refrigerant and feeding the sucked refrigerant into the compression chamber;

an oil stock portion for stocking the oil;

an oil path for injecting the oil into the compression chamber when the refrigerant is sucked into the compression chamber of the cylinder constituting the rotary compressing element; and an opening/closing valve for opening/closing the oil path in accordance with the refrigerant discharge pressure of the rotary compressing element or the pressure of the compressed refrigerant compressed by the rotary compressing element such that oil is supplied into the compression chamber when the refrigerant discharge pressure or the pressure of the compressed refrigerant is low, said valve including biasing means for moving the valve to the open position, wherein the opening/closing valve is disposed inside the cylinder, wherein the oil path includes an oil flowing groove that is formed between the cylinder and one of the primary bearing and the secondary bearing, wherein a part of the oil flowing groove is formed on an outer periphery of the opening/closing valve, and the oil flowing groove intercommunicates with the compression chamber and the oil stock portion, the opening/closing valve is disposed in the oil path, and the oil is adapted to flow from the oil stock portion through the oil flowing groove formed between the cylinder and one of the primary and secondary bearings into the compression chamber interlocking with the opening of the open/closing valve.

2. The hermetically sealed compressor according to claim 1, wherein the opening/closing valve is opened/closed in accordance with differential pressure between the refrigerant suction pressure and the reference discharge pressure of the compression chamber, and set to an open state when the differential pressure is low.

3. The hermetically sealed compressor according to claim 1, wherein the opening/closing valve is opened/closed in accordance with the pressure of the compressed refrigerant, and is set to an open state when the pressure of the compressed refrigerant is low.

4. The hermetically sealed compressor according to claim 3, further comprising a compressed refrigerant introducing path for applying the pressure of the compressed refrigerant discharged from a discharge pipe of the hermetically sealed container to the opening/closing valve.

5. The hermetically sealed compressor according to claim 1, wherein the oil flowing groove is formed at the outside of the opening/closing valve, and the oil is adapted to flow along the outside of the opening/closing valve into the compression element.

6. A hermitically sealed compressor comprising:

an electrically-driven element;

a rotary compressing element driven by the electrically-driven element to compress refrigerant; the rotary compressing element having a primary bearing, a secondary bearing and at least one cylinder that is sandwiched between the primary and secondary bearings and has a refrigerant inlet through which a refrigerant is adapted to flow under refrigerant suction pressure and a discharge outlet through which compressed refrigerant is adapted to flow under refrigerant discharge pressure and including a compression chamber in which the refrigerant is compressed;

a hermetically sealed container in which the electrically-driven element and the rotary compressing element are accommodated and oil is stocked, a refrigerant suction path for sucking refrigerant and feeding the sucked refrigerant into the compression chamber;

an oil stock portion for stocking the oil;

an oil path for injecting the oil into the compression chamber when the refrigerant is sucked into the compression chamber of the cylinder constituting the rotary compressing element; and an opening/closing valve for opening/closing the oil path in accordance with the refrigerant discharge pressure of the rotary compressing element or the pressure of the compressed refrigerant compressed by the rotary compressing element such that oil is supplied into the compression chamber when the refrigerant discharge pressure or the pressure of the compressed refrigerant is low, said valve including biasing means for moving the valve to the open position, wherein the oil path includes an oil flowing groove that is formed between the cylinder and one of the primary bearing and the secondary bearing and intercommunicates with the compression chamber and the oil stock portion, the opening/closing valve is disposed in the oil path, and the oil is adapted to flow from the oil stock portion through the oil flowing groove formed between the cylinder and one of the primary and secondary bearings into the compression chamber interlocking with the opening of the open/closing valve;

wherein the oil flowing groove comprises a first oil path penetrating from the outer peripheral surface to the oil stock portion, a second oil path that penetrates through the primary bearing in the thickness direction of the primary bearing and intercommunicates with the first oil path at one end thereof, a third oil path that is formed in the cylinder so as to intercommunicate with the other end of the second oil path and the compression chamber, and a fourth oil path that is formed around an outer periphery of the opening/closing valve so as to intercommunicate with the third oil path when the refrigerant discharge pressure of the pressure of the compressed refrigerant is low.

* * * * *